US005898143A

United States Patent [19]

Da Dalt

[11] Patent Number: 5,898,143

[45] Date of Patent: Apr. 27, 1999

[54] KEY-OPERATED ELECTRIC SAFETY SWITCH

[75] Inventor: Hugues Da Dalt, L'Isle D'Espagnac, France

[73] Assignee: Schneider Electric SA, Boulogne Billancourt, France

[21] Appl. No.: 08/760,762

[22] Filed: Dec. 5, 1996

[30] Foreign Application Priority Data

Dec. 5, 1995 [FR] France ..... 95-14949

[51] Int. Cl.[6] ..... H01H 27/00

[52] U.S. Cl. ..... 200/17 R; 200/43.07

[58] Field of Search ..... 200/17 R, 43.01, 200/43.04–43.09, 61.62–61.68, 334

[56] References Cited

U.S. PATENT DOCUMENTS

| | | | |
|---|---|---|---|
| 4,658,102 | 4/1987 | Seim et al. | 200/17 R |
| 4,963,706 | 10/1990 | Mohtasham | 200/334 |
| 5,420,385 | 5/1995 | Cooper | 200/43.07 |
| 5,464,954 | 11/1995 | Kimura et al. | 200/61.62 |
| 5,516,993 | 5/1996 | Wecke et al. | 200/17 R |
| 5,622,253 | 4/1997 | Wecke et al. | 200/43.07 |
| 5,703,339 | 12/1997 | Rapp et al. | 200/17 R |

FOREIGN PATENT DOCUMENTS

| | | | |
|---|---|---|---|
| 3302631A1 | 8/1984 | Germany | H01H 9/20 |
| 4338910C1 | 2/1995 | Germany | H01H 13/18 |
| 2173043 | 10/1986 | United Kingdom | H01H 27/00 |

*Primary Examiner*—Michael A. Friedhofer
*Attorney, Agent, or Firm*—Oblon, Spivak, McClelland, Maier & Neustadt, P.C.

[57] ABSTRACT

A key-operated safety switch including a control roller and a component for unlocking the control roller. The unlocking component may be applied by way of a cam surface against a lock engaged in a catch of the control roller, so as to free the control roller when the key is inserted.

11 Claims, 5 Drawing Sheets

KEY-OPERATED ELECTRIC SAFETY SWITCH

BACKGROUND OF THE INVENTION

FIELD OF THE INVENTION

This invention concerns a key-operated electric safety switch comprising a casing surmounted by a control head and housing elements of electrical contact, the control head including a control roller capable of acting on the contact elements, and an unlocking component associated with the control roller in order to free said roller, the unlocking component and the control roller being controlled by the key when said key is inserted in the head.

DISCUSSION OF THE BACKGROUND

Safety switches of this type are well known (see, for example, documents DE-33 02631 and EP-507 842). In these switches, the control roller is capable of turning around an axis in order to control the contact elements via a push-button and the control head presents at least one passage slot for the key in a general direction perpendicular to the rotation axis of the roller.

Known mechanisms for freeing the control roller do not easily lend themselves to an actuation in one or other of two directions perpendicular between each other and to the rotation axis of the control roller. Now, the possibility of such a dual insertion of the key may turn out to be very useful inasmuch as it provides for increased flexibility in the assembly of the safety switch.

Moreover, it is desirable to strengthen the impregnability of safety switches by fitting the key, the control roller and its unlocking component in an appropriate manner.

SUMMARY OF THE INVENTION

The purpose of this invention is thus to provide the switch with a high degree of impregnability and reliability by means of a mechanism permitting the insertion of the control key in a direction orthogonal to the axis of the control roller or in two directions orthogonal to each other and to the rotation axis of the roller.

According to the invention, in a safety switch of the type described above, a lock of the control roller is housed in the head and solicited elastically so as to be inserted in a catch of the control roller, and the unlocking component may be applied by means of a cam surface against the lock so that it is freed when the key is inserted. It should be noted that the locking of the control roller in a safety position or in an off-position is due to the lock and that the control roller is freed by the action of the unlocking roller on the lock, that is to say indirectly.

The unlocking component is preferentially a rotating roller adjacent to and coaxial with the control roller, presenting on its periphery at least one notch for receiving the key, the shapes of the notches of the control roller and the unlocking roller and the control key being such that, when first introduced, the key actuates the unlocking roller before the control roller. The notch of the unlocking roller then extends, for example, over an angle which is greater than the control roller. With a view to distributing the efforts, two unlocking rollers may be provided, said unlocking rollers being positioned symmetrically in relation to a central control roller, this central control roller being linked to the push-button through the intermediary of a small connecting rod linked to the central control roller and the push-button.

In a preferred embodiment, provision is made for two unlocking rollers positioned symmetrically in relation to a central control roller, this central control roller being connected by a pin link and control groove to the crosshead of a block link equipped with a tail constituting the push-button, the guiding of the block being assured both by its tail in an aperture of the control head or the casing and by a guiding groove of its crosshead cooperating with the shaft or the rotating axis of the control roller. The control roller may advantageously consist of two rollers each coupled on the outer side with an unlocking roller and joined to each other on the inner side by the axis of the connecting rod or the slider. In an embodiment with twin control rollers, the crosshead may be positioned centrally; in an embodiment with a single central control roller, the crosshead may be a fork presenting arms equipped with control grooves and guiding grooves, these arms enveloping the unlocking rollers laterally.

BRIEF DESCRIPTION OF THE DRAWINGS

The constitution and characteristics of the safety switch according to the invention may be understood from the ensuing description of an embodiment and the accompanying drawings.

DESCRIPTION OF THE PREFERRED EMBODIMENTS

Figure 1:
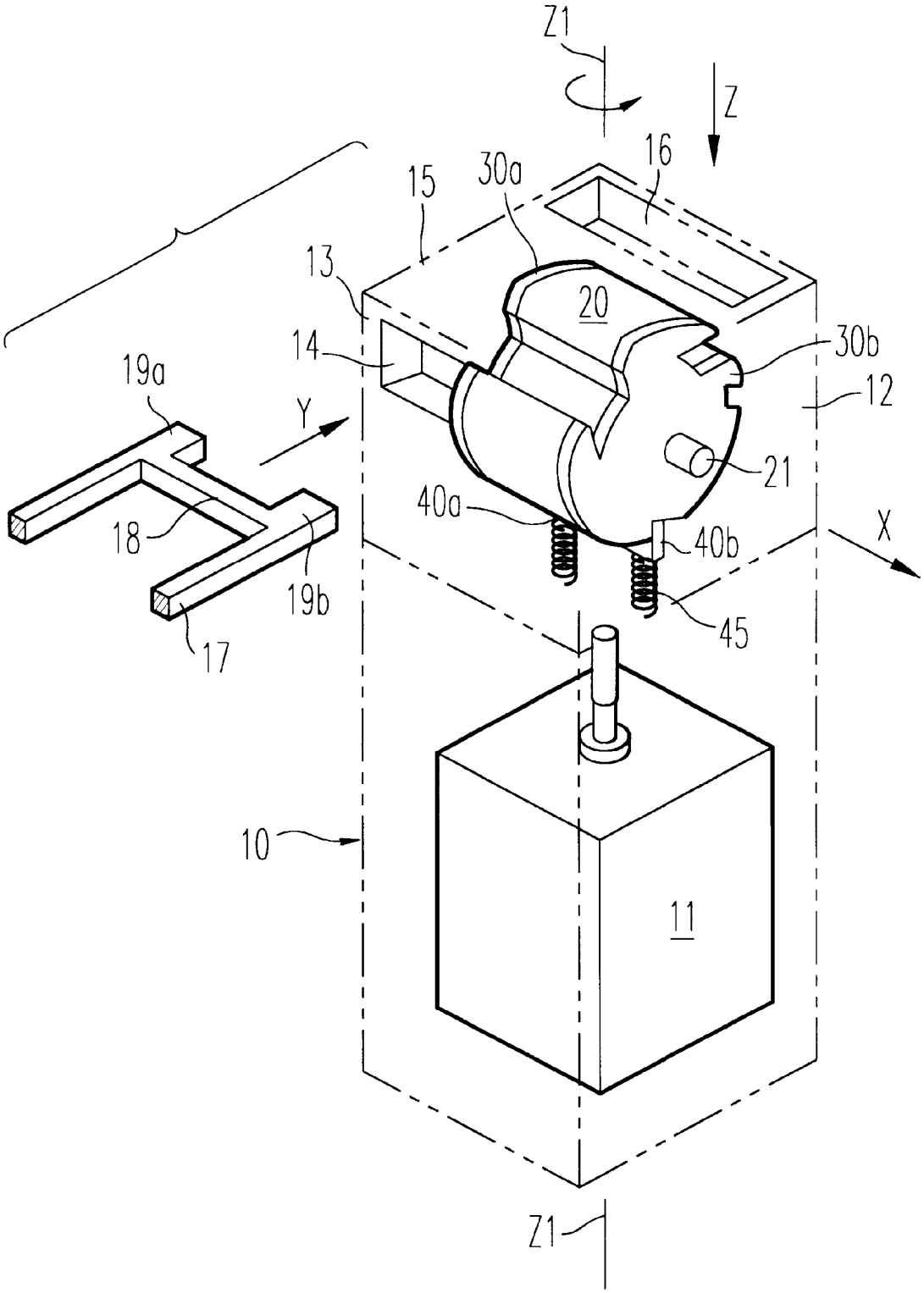
FIG. 1 represents in diagram form a perspective view of the safety switch.

The safety switch illustrated in FIG. 1 comprises both a casing 10 lying in a direction Z and comprising a block of electrical contacts 11 and a square-shaped control head 12 fixed on the casing 10 so that, a user may choose four different positions displaced by pivoting at 90° around an axis Z1 of direction Z. The head 12 is fitted to the casing by any known means allowing pivoting up to the required position and holding in this position.

The control head 12 has in one of its lateral faces 13 a slot 14 and in its upper face 15 opposite the block 11 an identical slot 16; the slots 14 and 16 are made to a dimension allowing the passage in one or the other of said slots of a flat control key 17 which may be displaced respectively in a direction Y or Z in function of the movement of a support (not represented) of this key. The key 17 is, for example, attached in a rigid or oscillating manner to a door enclosing electrical material or a machine in order to establish a correlation between the closing of this door and the authorization to use the material or machine provided by the block of contacts. The control key 17 has a special shape, designed as far as possible to make the switch impregnable. It presents by known means a transverse control bar 18, perpendicular to its direction of movement, in order to cooperate with a control roller 20 fitted rotationally in the head 12 by means of a shaft 21 of axis X perpendicular to directions Y and Z and resting in bearings of the head. The key also comprises two lateral ears 19*a*, 19*b* located level with and slightly in advance of the bar so as to cooperate with two indirect unlocking rollers 30*a*, 30*b* of the control roller.

The unlocking rollers 30*a*, 30*b* are of reduced thickness and are housed in the control head of each side of the control roller 20 by means of assembly on the same rotation shaft 21 of axis X. Although the control roller 20, and the unlocking rollers 30*a*, 30*b* have similar overall shapes, forming part of a same circular contour, there are certain differences. They cooperate with a pair of locks, respectively marked 40*a*, 40*b*, fitted in sliding manner in direction Z in housings 40*c* provided in the cylindrical lower wall of the control head 12, on either side of an aperture provided for the passage of a connecting rod 42 articulated with an axis 22 of the control roller 20 and with an axis 43 of a push-button 44 guided into the cylindrical lower part of the aperture 41 and designed to actuate the contact block 11. The axis 22 is housed in a central hollowing 23 of the control roller 20 which is sufficiently large to allow the functional displacement of the connecting rod (see FIG. 3). It will also be noted that, when in the off position, the connecting rod 42 is oriented in a direction close to the axis Z1.

The control roller 20 presents two notches 24, 25 of identical shape on its periphery. The notch 24 comprises a front edge 24*a* on which is applied the front of the bar 18 of the key 17 pushed into the slot 14 in the direction Y, and a rear edge 24*b* on which is applied the rear of the bar 18 when the key is withdrawn. A locking catch 26 is provided on the periphery of the control roller; the shape of the catch enables the locks 40*a*, 40*b* to be engaged under the effect of their return springs 45. Another catch 27 is provided on the periphery of the control roller for the application of a pin part 46*a* of a return spring 46 common to the rollers. A stop may be located on the periphery of the roller in order to bring it to a stop against a shoulder of the control head and thus to confirm the locking position.

Figure 2:
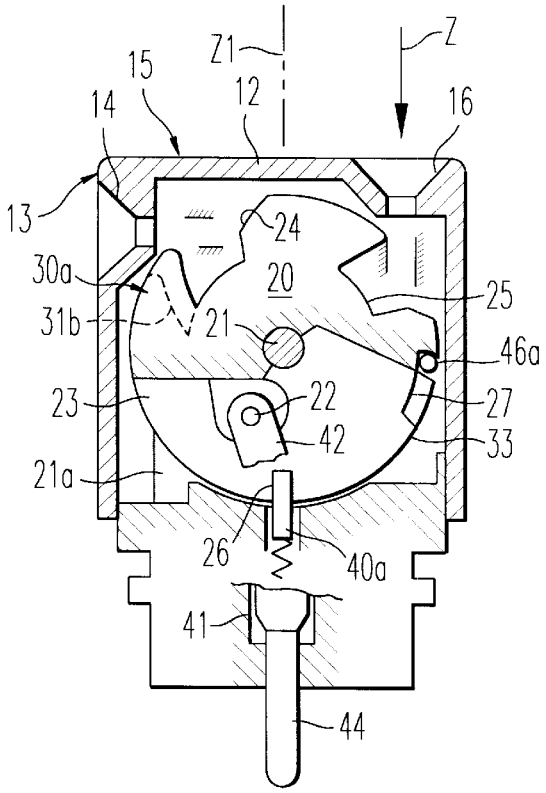
FIGS. 2 and 3 shows a front view of a control head with connecting rod of the switch, respectively in off position and on position.
Figure 4:
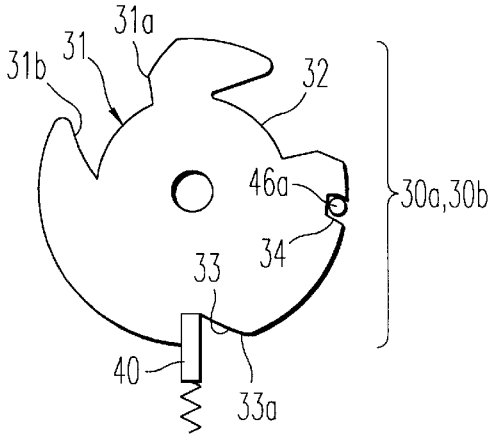
FIGS. 4 and 5 show respectively an unlocking roller and a control roller.
Figure 3:
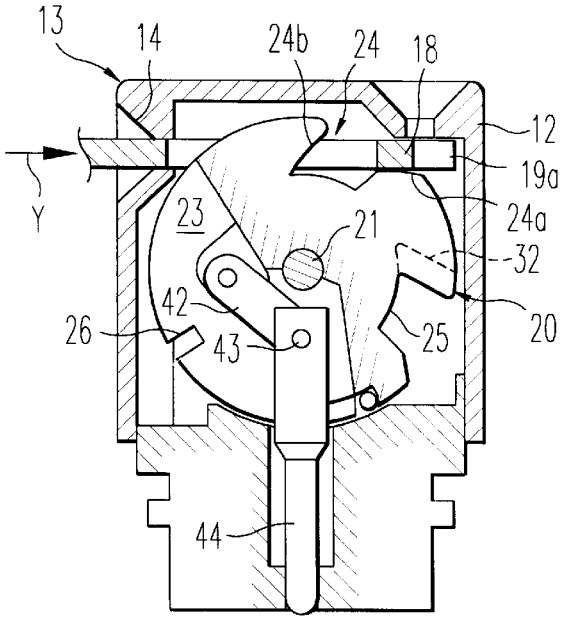
Figure 5:
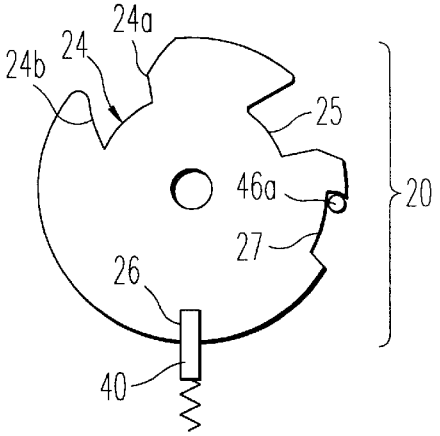
Figure 6:
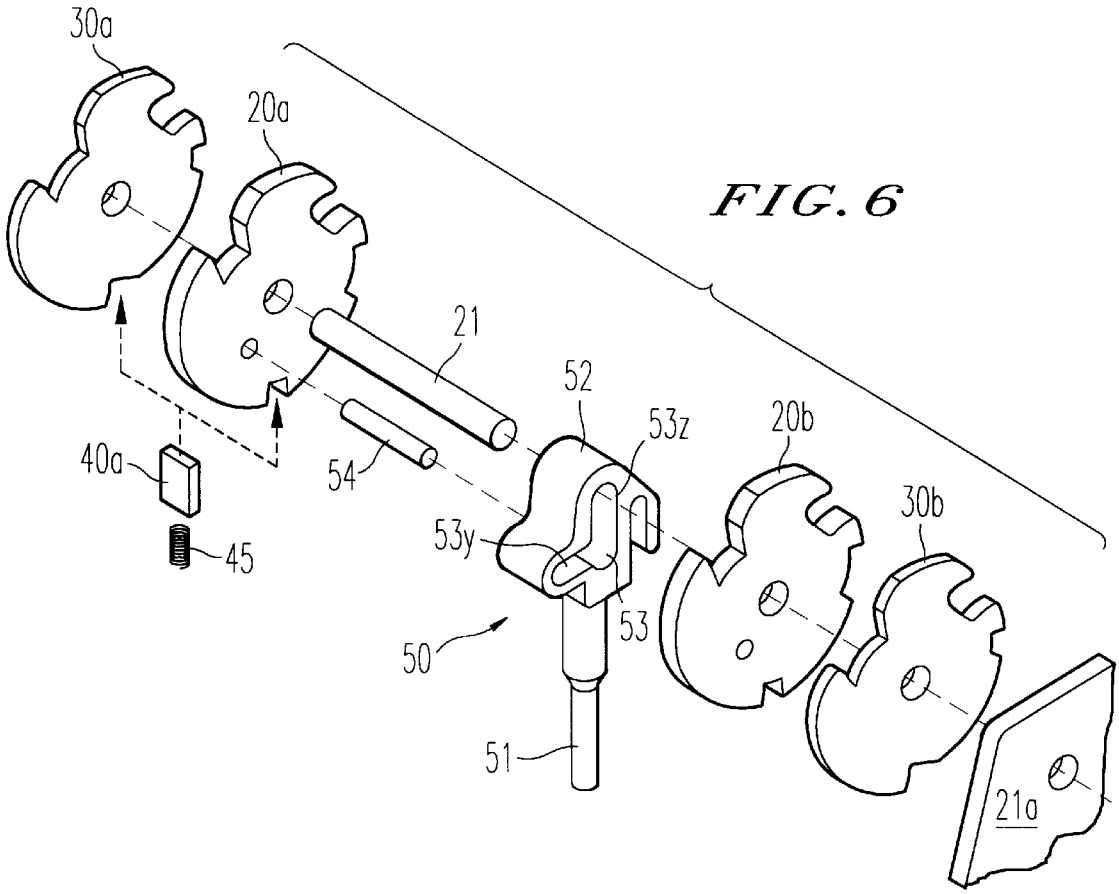
FIG. 6 is an exploded perspective view of a part of the mechanism of a control head with slider.
Figure 7:
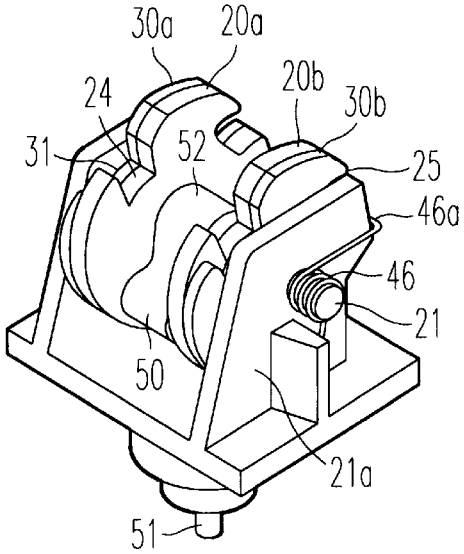
FIG. 7 shows a part of the same mechanism when assembled.

Each roller 30*a*, 30*b* comprises two notches 31, 32 of identical shape. The notch 31 presents a front edge 31*a* located, when in the off position, at the level of the front edge 24*a* of the notch 24 of the roller 20; an ear 19 of the key 17 may be applied on this edge 31*a*. The notch 31 also presents a rear edge 31*b* located, when in the off position, short of the rear edge 24*b* of the notch 24 (see FIG. 2). A cam surface 33*a* is attached to a catch 33 of each roller 30*a*, 30*b* said catch 33 cooperating with a lock 40 so that said lock retracts as soon as the roller 30 starts to rotate in a clockwise direction (FIGS. 2 to 4). A catch 34 is located on the periphery of the rollers 30*a*, 30*b* at the level of the catch 27 of the roller 20, but extending over a smaller sector, in order to house the pin part 46*a* of the spring 46.

In the embodiment illustrated in FIGS. 6 to 10, the safety switch comprises two control rollers 20*a*, 20*b* and two unlocking rollers 30*a*, 30*b* coupled to the exterior of the control rollers 20*a*, 20*b*. The profiles of the rollers are similar to those of the previous embodiment. The control rollers 20*a*, 20*b* are connected to the push-button by means of a slider 50 equipped with a tail 51 forming the push-button itself and with a crosshead 52 presenting an opening 53 penetrated by a control axis 54 coupling the two control rollers 20*a*, 20*b*. The opening 53 can have any appropriate shape; here it has an L-shape with a vertical groove 53*z*, in other words oriented in the direction Z, and with a horizontal groove 53*y*, in other words oriented in the direction Y. A control axis 54 coupling the control rollers 20*a*, 20*b* is inserted in the control groove 53*y* in such a way that the axis movement generated by the movement of the key 17 causes the displacement of the slider 50; the shaft 21 on which the four rollers 20*a*, 20*b*, 30*a*, and 30*b* pivot is fitted into the guiding groove 53*z* thereby forcing the slider 50 to travel in translatory motion in the direction Z. The shaft 21 is fitted in wall bearings 21*a* of the control head, these walls being of a size capable of withstanding the considerable stress exerted on the shaft.

The return spring 46 of the rollers also returns the slider 50 in the up off-position. A specific return switch for the slider may also be provided in both of the embodiments described. Although two return springs 45 are associated with the locks 40, a common return spring may also be provided for the two locks. As a variant, the unlocking rollers may possess a diameter differing slightly from the control roller or rollers.

Figure 11:
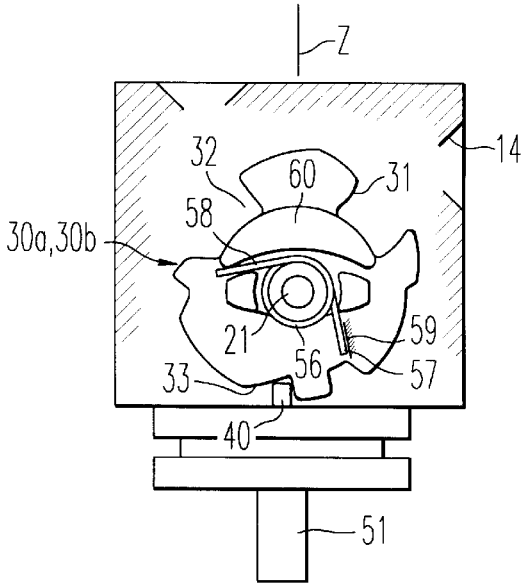
FIG. 11 shows in diagram form a front view of a variant unlocking roller.
Figure 12:
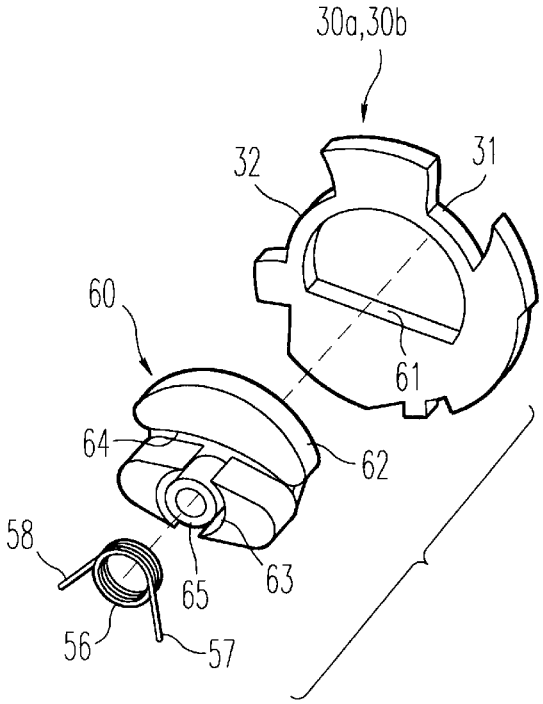
FIG. 12 is a perspective view of the roller in FIG. 11.

In the variant illustrated in FIGS. 11 and 12, a return spring 56 is associated with each unlocking roller 30*a*, 30*b*; in order to facilitate comprehension, the control roller or rollers have not been represented. The spring 56 is a torsion spring fitted in a thin support component 60 which is itself enclosed or embedded, over part of its thickness, in a suitable opening 61 of the unlocking roller so as to be firmly attached to it in rotation; the component 60 may of course be assembled on the unlocking roller in another way. The component 60 comprises a body 62 profiled to fit in with the profile of the notches 31, 32 of the unlocking rollers 30*a*, 30*b* so as not to hinder manipulation of the key; the body 62 presents housings 63, 64 respectively for the branches 57, 58 of the torsion spring 56; the branch 57 is applied against a fixed stop of the control head 12.

Figure 13:
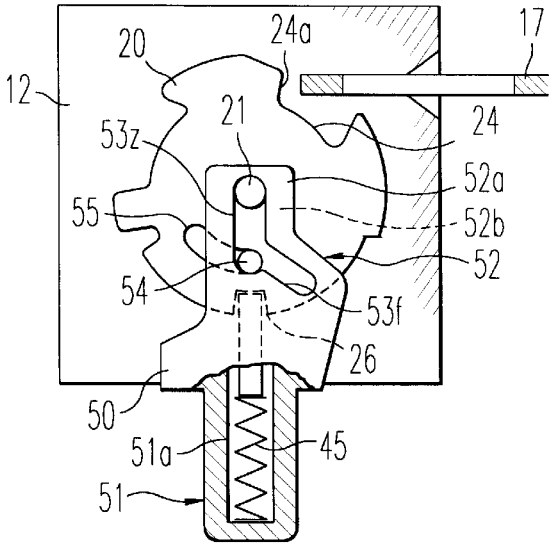
FIGS. 13 and 14 show, respectively in inactive and active position, a slider variant equipped with a fork-shaped crosshead.
Figure 14:
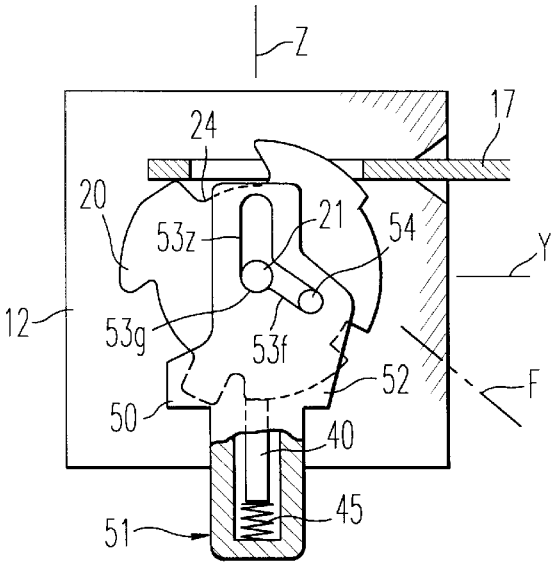

In the variant illustrated in FIGS. 13 and 14, a single control roller 20 is provided, inserted between two unlocking rollers 30*a*, 30*b*; to facilitate understanding, only the roller 20 is represented. The slider 50 houses, in a hollowing 51*a* of its tail 51 forming the push-button associated with the contact block, the locks 40 and their return spring 45, the locks being guided by suitable conformations of the hollowing; in its upper part the slider 50 presents a fork-shaped crosshead whose arms 52*a*, 52*b* laterally envelop the rollers 30*a*, 30*b*. Each arm comprises a vertical guiding groove 53*z* and a control groove 53*f* oriented on an axis F inclined in relation to the direction Y. This inclination makes it possible to generate a given translatory motion of the push-button by means of an angular displacement of the rollers which is less than in the case of FIGS. 6 to 10. A recess 53*g* is provided at the point of convergence of the grooves 53*z*, 53*f* in order to stabilize the base of the axis 54. Said axis 54 moves in an opening 55 of the roller 20.

Figure 9:
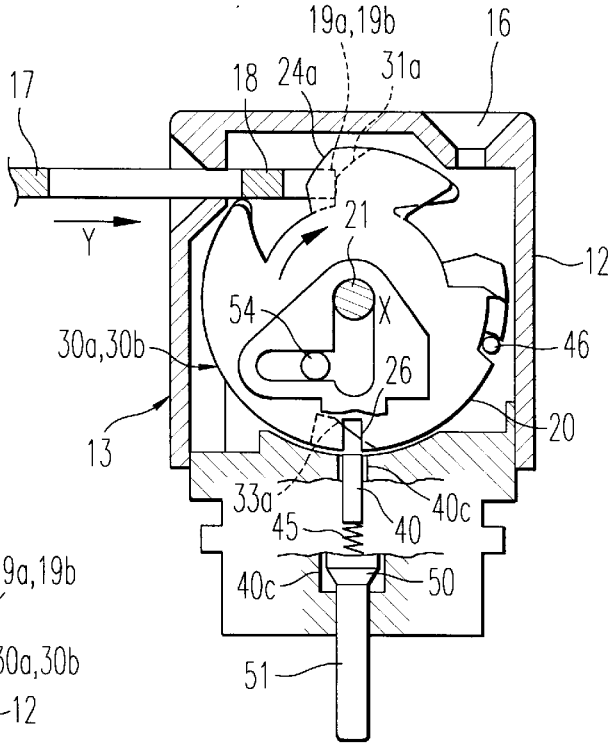
Figure 10:
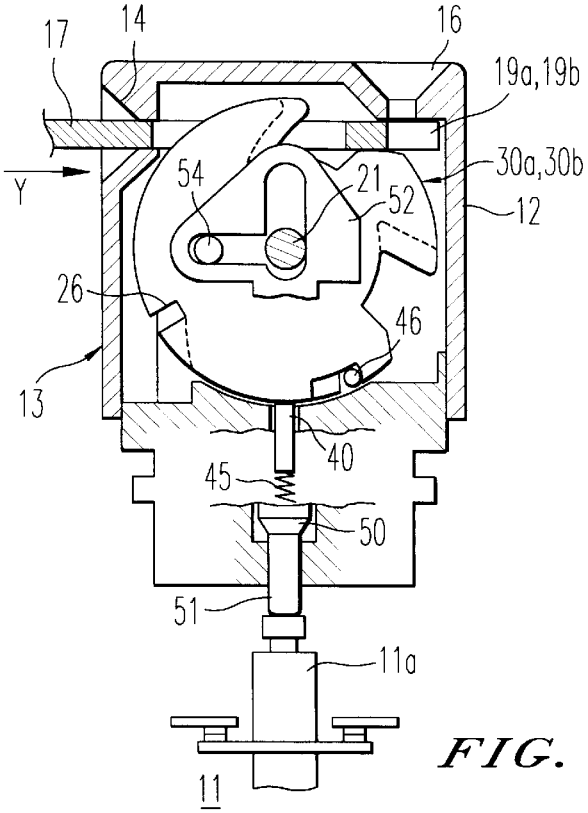

The functioning of the safety switch will now be described, reference being made to FIGS. 8 to 10.

Figure 8:
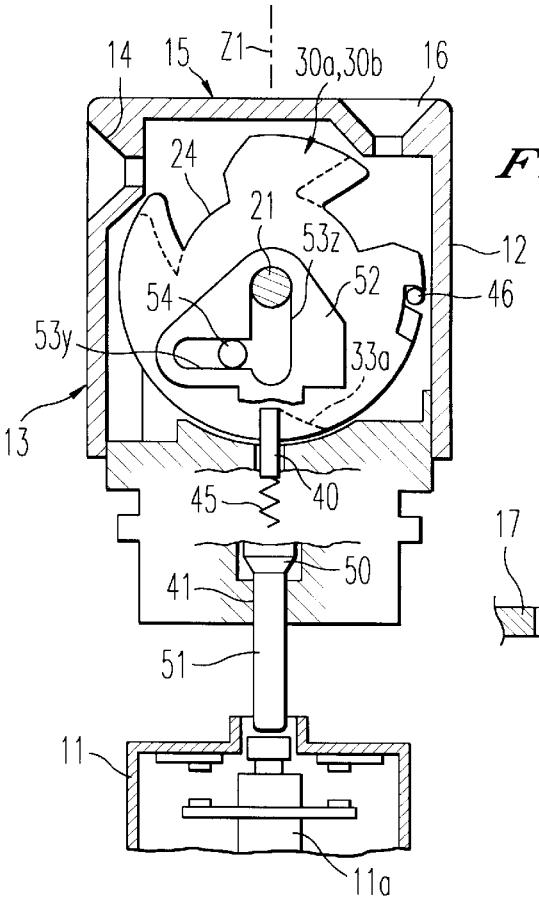
FIGS. 8 to 10 illustrate the operating and the control head with slider.

The control head is illustrated in off position in FIG. 8, the control key 17, linked to the enclosure or machine door, being then removed from the switch and the contact block being then solicited by the push-button 51. When the door is closed and it is required to activate the controlled system, the control key 17 is inserted in the slot 14 (or in the slot 16 depending on the previously chosen assembly). As may be seen from FIG. 9, the ears 19*a*, 19*b* of the key are first applied on the front edge 31*a* of the notches 31 and cause the unlocking rollers to rotate in a clockwise direction against the force of the spring 46; the strip 18 is not yet applied against the front edge 24*a* of the notches 24 of the control rollers 20; the cam surfaces 33*a* of the catches 33 repulse the locks 40 by compressing their return springs 45, and the strip 18 is then applied against the edges 24*a* (see FIG. 9) and the rollers 20, now unlocked, also begin to turn in a clockwise direction. The key 17 continues to advance and causes the series of rollers 20, 30*a*, 30*b* to turn in concert; the rotation of the control rollers 20 leads to the rotation of the control axis 54 causing the rise of the slider 50 guided by its push-button tail 51 in the bore 41 and by the groove 53*z* against the shaft 21. The push-button 51 withdraws from the control component 11*a* of the contact block 11, freeing said block whose contacts commute in order to activate the controlled system (see FIG. 10).

When the door is opened, the control key 17 moves in the opposite direction into the slot 14 and, by the rear heel of the bar 18, is applied against the rear edges 24*b*, 31*b*, of the rollers 20, 30*a*, 30*b* which turn together in an anticlockwise direction, this movement being assisted by the expansion of the spring 46; the slider falls back to commute the contacts of the block 11. The cam surfaces 33*a* of the unlocking rollers 30 free the locks 40 which are reinstalled under the effect of their springs 47 in the catches 26 of the control rollers 20 and the catches 33 of the rollers 30*a*, 30*b* thereby defining the stop position of these rollers. The appliance now returns to the off position illustrated in FIG. 8.

I claim:

1. A key-operated electric safety switch, comprising:

a casing surmounted by a control head and housing elements of an electrical contact, the control head including:

a control roller capable of rotating on a first axis in order to control the contact elements via a push-button;

at least one slot for a passage of a control key capable of being inserted in the control head or extracted from the control head in a general direction perpendicular to the first axis so as to cooperate with at least one first notch provided on a periphery of the control roller and to cause said control roller to pivot; and an unlocking component associated with the control roller so as to unlock the control roller through an application of the key against said unlocking component, wherein:

a lock of the control roller is housed in the control head in such a way as to move perpendicularly to the first axis of the control roller and is retractable so as to be inserted in a catch of the control roller, and the unlocking component may be applied by means of a cam surface of said unlocking component against the lock in order to free the catch when the control key is inserted.

2. A switch according to claim 1, wherein the unlocking component is a rotating roller adjacent to and coaxial with the control roller, having at least one second notch on a periphery of said rotating roller for receiving the control key, and wherein a shape of said at least one first notch of the control roller, a shape of said at least one second notch of the rotating roller, and a shape of the control key being such that, when first introduced, the control key actuates the unlocking roller before the control roller.

3. A switch according to claim 2, wherein said at least one second notch of the rotating roller extends over an angle which is greater than the at least one first notch of the control roller.

4. A switch according to claim 1, wherein said unlocking component comprises two unlocking rollers being positioned symmetrically in relation to the control roller, the control roller being linked to the push-button through an intermediary connecting rod articulated with the control roller and the push-button.

5. A switch according to claim 1, wherein said unlocking component comprises two unlocking rollers being positioned symmetrically in relation to the control roller, the control roller being linked by an axis liaison and control groove to a crosshead of a slider fitted with a tail constituting the push-button.

6. A switch according to claim 5, wherein the slider is guided by both the tail into a cylindrical aperture of the control head or the casing and by a guiding groove of the crosshead of said slider against a rotation shaft of the control roller.

7. A switch according to claims 4 or 5, wherein the control roller includes two rollers each paired with one of the two unlocking rollers.

8. A switch according to claims 5 or 6, wherein the tail of the slider houses the lock and a return spring of said lock.

9. A switch according to claims 5 or 6, wherein the crosshead of the slider includes arms which laterally envelop the unlocking rollers.

10. A switch according to claim 5, wherein each of the unlocking rollers is firmly attached in rotation to a support component of an individual return spring.

11. A switch according to claim 5, wherein the control groove is oriented along an inclined axis.

* * * * *